US006295768B1

(12) United States Patent
Romero

(10) Patent No.: US 6,295,768 B1
(45) Date of Patent: Oct. 2, 2001

(54) PREFABRICATED STRUCTURE

(76) Inventor: Mario R. Romero, P.O. Box #322, Maxwell, NM (US) 87728

( * ) Notice: Subject to any disclaimer, the term of this patent is extended or adjusted under 35 U.S.C. 154(b) by 0 days.

(21) Appl. No.: 09/616,915

(22) Filed: Jul. 14, 2000

(51) Int. Cl.[7] ..... E04B 7/00

(52) U.S. Cl. ..... 52/82; 52/79.4; 52/79.6; 52/81.5; 52/245

(58) Field of Search ..... 52/79.4, 79.6, 52/79.8, 79.9, 266, 270, 288.1, 245, 246, 275, 276, 278, 459, 81.4, 81.5, 82

(56) References Cited

U.S. PATENT DOCUMENTS

| | | | | |
|---|---|---|---|---|
| D. 306,761 | | 3/1990 | Caraco . | |
| 3,152,366 | * | 10/1964 | McCrory et al. | 52/79.4 |
| 3,835,602 | * | 9/1974 | Tuuri | 52/82 |
| 4,173,855 | | 11/1979 | Raptonplous . | |
| 4,335,558 | | 6/1982 | Caldwell et al. . | |
| 4,426,814 | | 1/1984 | Stulmer . | |
| 4,672,779 | * | 6/1987 | Boyd | 52/82 X |
| 4,739,594 | | 4/1988 | Langford et al. . | |
| 5,383,313 | * | 1/1995 | Deeke et al. | 52/82 |
| 5,555,681 | | 9/1996 | Cawthon . | |

* cited by examiner

*Primary Examiner*—Carl D. Friedman
*Assistant Examiner*—Brian E. Glessner

(57) ABSTRACT

A prefabricated structure for quickly erecting a gazebo and for combining a plurality of gazebos. The prefabricated structure includes a deck. The deck generally has a geometric shape such that a perimeter of the deck comprises a plurality of side edges. Each of a plurality of wall panels has a bottom edge, and a top edge. Each of the wall panels are positioned against one of the side edges of the deck and securely attached thereto. At least one of the wall panels has door therein. A plurality of roof panels each has a generally trapezoidal shape such that each of the roof panels comprises a first base, a second base, and two legs. The first base has a greater length than the second base. Each of the second bases and the legs has a lip extending downwardly therefrom. Each of the roof panels has a channel therein orientated generally perpendicular to and positioned generally adjacent to the first base. A central member couples to each of the second bases. Each of the second bases is securely attached to central member, and each of the top edges of the wall panels is positioned in one of the channels of the roof panels.

8 Claims, 9 Drawing Sheets

PREFABRICATED STRUCTURE

BACKGROUND OF THE INVENTION

1. Field of the Invention

The present invention relates to prefabricated structures and more particularly pertains to a new prefabricated structure for quickly erecting a gazebo and for combining a plurality of gazebos.

2. Description of the Prior Art

The use of prefabricated structures is known in the prior art. More specifically, prefabricated structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,739,594; 4,335,558; 4,426,814; 5,555,681; 4,173,855; and U.S. Pat. Des. No. 306,761.

While these devices fulfill their respective, particular objectives and requirements, the aforementioned patents do not disclose a new prefabricated structure. The inventive device includes a deck. The deck generally has a geometric shape such that a perimeter of the deck comprises a plurality of side edges. Each of a plurality of wall panels has a bottom edge, and a top edge. Each of the wall panels are positioned against one of the side edges of the deck and securely attacked thereto. At least one of the wall panels has door therein. A plurality of roof panels each has a generally trapezoidal shape such that each of the roof panels comprises a first base, a second base, and two legs. The first base has a greater length than the second base. Each of the second bases and the legs has a lip extending downwardly therefrom. Each of the roof panels has a channel therein orientated generally perpendicular to and positioned generally adjacent to the first base. A central member couples to each of the second bases. Each of the second bases is securely attached to central member, and each of the top edges of the wall panels is positioned in one of the channels of the roof panels.

In these respects, the prefabricated structure according to the present invention substantially departs from the conventional concepts and designs of the prior art, and in so doing provides an apparatus primarily developed for the purpose of quickly erecting a gazebo and for combining a plurality of gazebos.

SUMMARY OF THE INVENTION

In view of the foregoing disadvantages inherent in the known types of prefabricated structures now present in the prior art, the present invention provides a new prefabricated structure construction wherein the same can be utilized for quickly erecting a gazebo and for combining a plurality of gazebos.

The general purpose of the present invention, which will be described subsequently in greater detail, is to provide a new prefabricated structure apparatus and method which has many of the advantages of the prefabricated structures mentioned heretofore and many novel features that result in a new prefabricated structure which is not anticipated, rendered obvious, suggested, or even implied by any of the prior art prefabricated structures, either alone or in any combination thereof.

To attain this, the present invention generally comprises a deck. The deck generally has a geometric shape such that a perimeter of the deck comprises a plurality of side edges. Each of a plurality of wall panels has a bottom edge, and a top edge. Each of the wall panels are positioned against one of the side edges of the deck and securely attacked thereto. At least one of the wall panels has door therein. A plurality of roof panels each has a generally trapezoidal shape such that each of the roof panels comprises a first base, a second base, and two legs. The first base has a greater length than the second base. Each of the second bases and the legs has a lip extending downwardly therefrom. Each of the roof panels has a channel therein orientated generally perpendicular to and positioned generally adjacent to the first base. A central member couples to each of the second bases. Each of the second bases is securely attached to central member, and each of the top edges of the wall panels is positioned in one of the channels of the roof panels.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new prefabricated structure apparatus and method which has many of the advantages of the prefabricated structures mentioned heretofore and many novel features that result in a new prefabricated structure which is not anticipated, rendered obvious, suggested, or even implied by any of the prior art prefabricated structures, either alone or in any combination thereof.

It is another object of the present invention to provide a new prefabricated structure which may be easily and efficiently manufactured and marketed.

It is a further object of the present invention to provide a new prefabricated structure which is of a durable and reliable construction.

An even further object of the present invention is to provide a new prefabricated structure which is susceptible of a low cost of manufacture with regard to both materials and labor, and which accordingly is then susceptible of low prices of sale to the consuming public, thereby making such prefabricated structure economically available to the buying public.

Still yet another object of the present invention is to provide a new prefabricated structure which provides in the apparatuses and methods of the prior art some of the advantages thereof, while simultaneously overcoming some of the disadvantages normally associated therewith.

Still another object of the present invention is to provide a new prefabricated structure for quickly erecting a gazebo and for combining a plurality of gazebos.

Yet another object of the present invention is to provide a new prefabricated structure which includes a deck. The deck generally has a geometric shape such that a perimeter of the deck comprises a plurality of side edges. Each of a plurality of wall panels has a bottom edge, and a top edge. Each of the wall panels are positioned against one of the side edges of the deck and securely attacked thereto. At least one of the wall panels has door therein. A plurality of roof panels each has a generally trapezoidal shape such that each of the roof panels comprises a first base, a second base, and two legs. The first base has a greater length than the second base. Each of the second bases and the legs has a lip extending downwardly therefrom. Each of the roof panels has a channel therein orientated generally perpendicular to and positioned generally adjacent to the first base. A central member couples to each of the second bases. Each of the second bases is securely attached to central member, and each of the top edges of the wall panels is positioned in one of the channels of the roof panels.

Still yet another object of the present invention is to provide a new prefabricated structure that allows a builder to combine multiple gazebos in an efficient manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
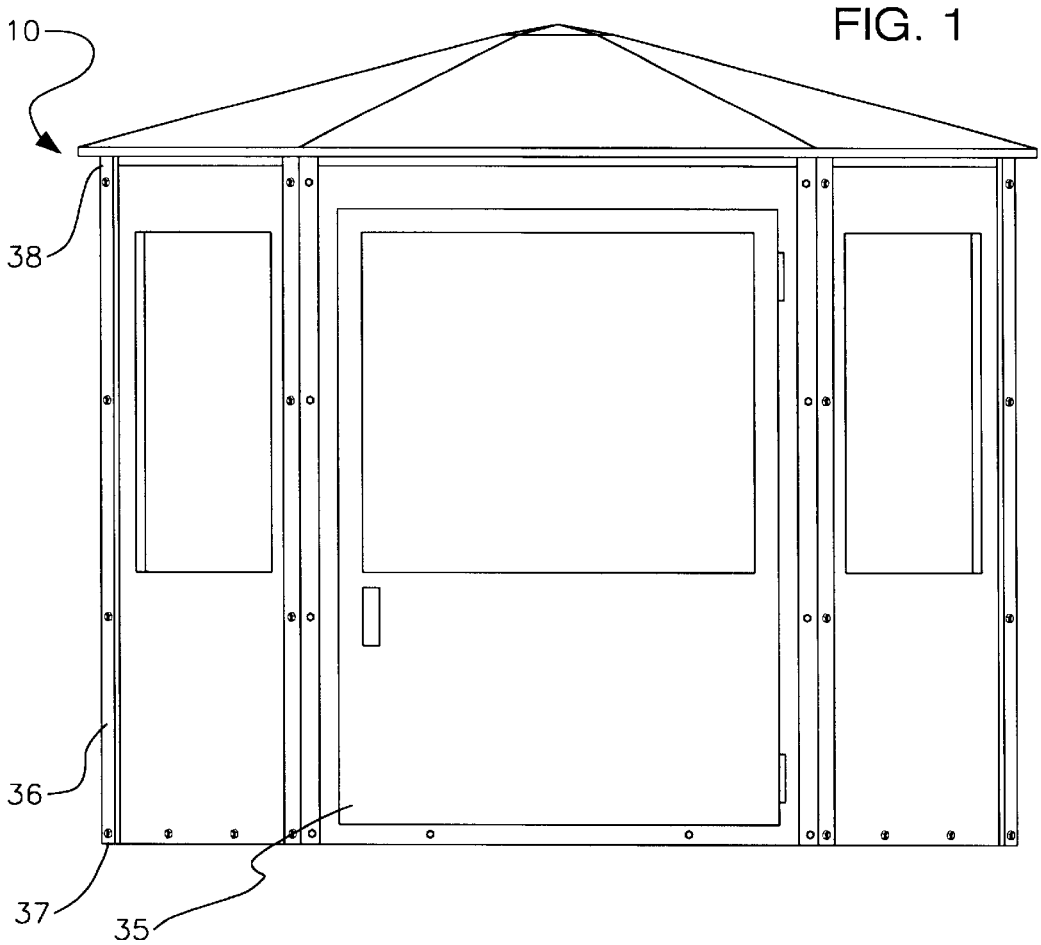
FIG. 1 is a schematic side view of a new prefabricated structure according to the present invention.
Figure 2:
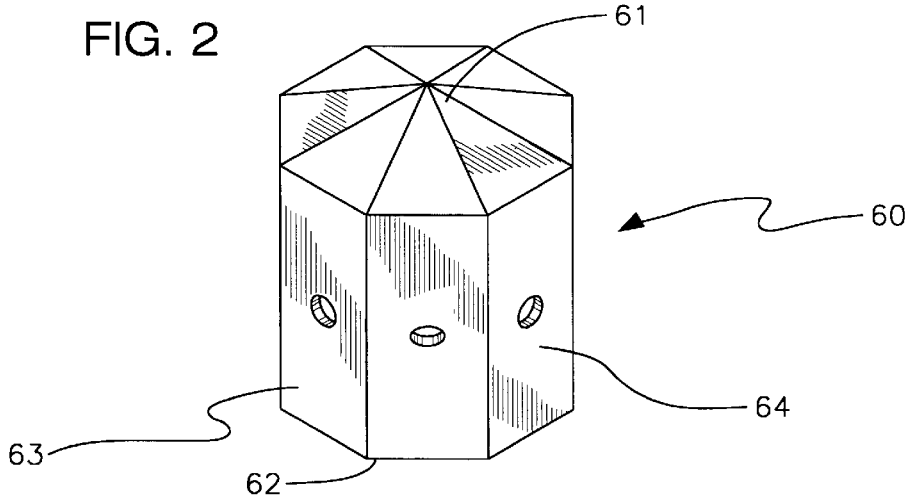
FIG. 2 is a schematic perspective view of the central member of the present invention.
Figure 3:
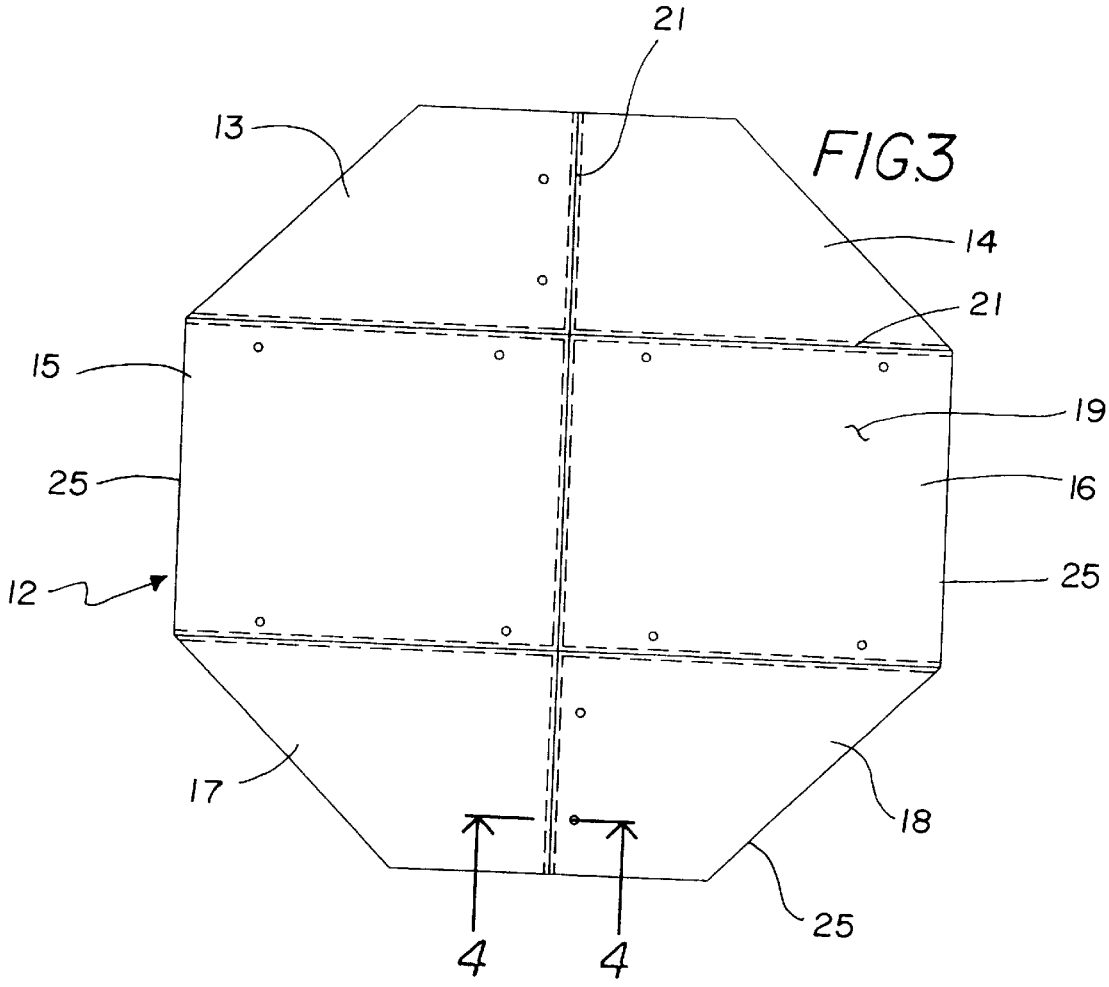
FIG. 3 is a schematic plan view of the deck of the present invention.
Figure 4:
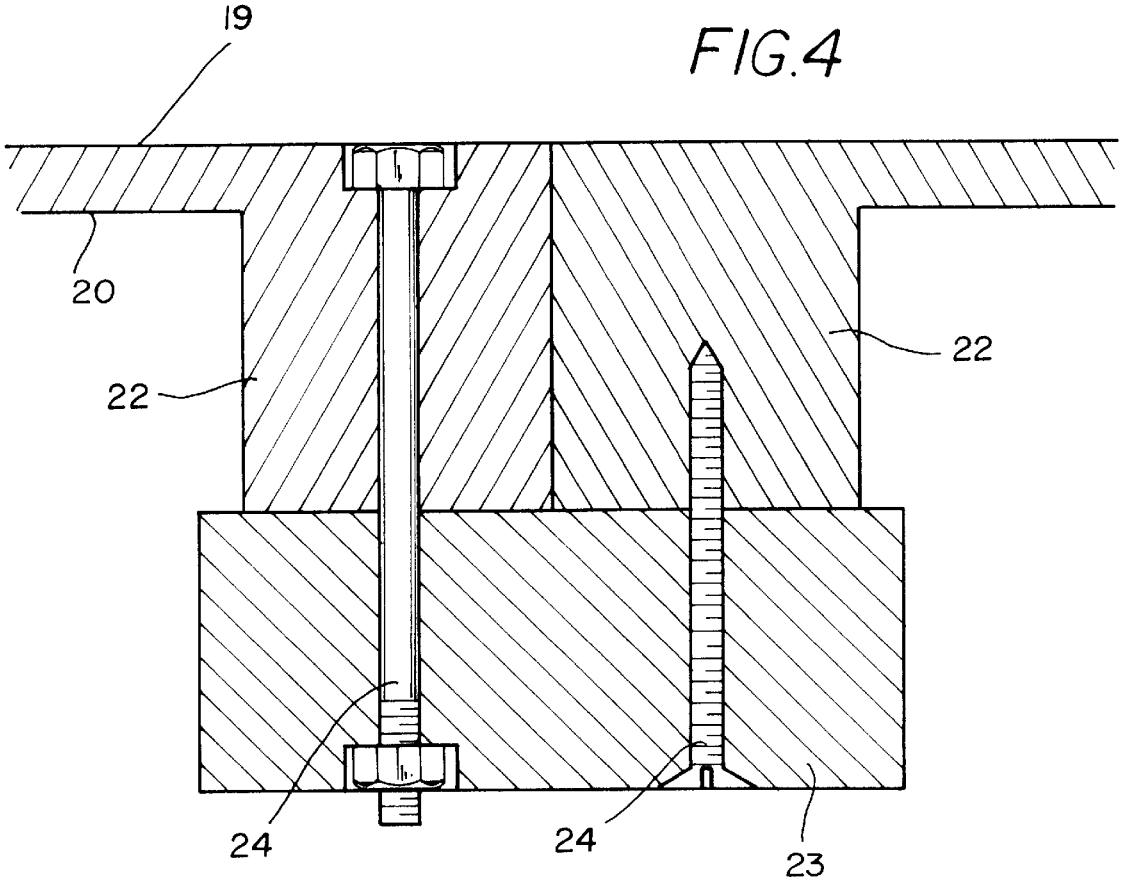
FIG. 4 is a schematic cross-sectional view taken along line 4—4 of the present invention.
Figure 5:
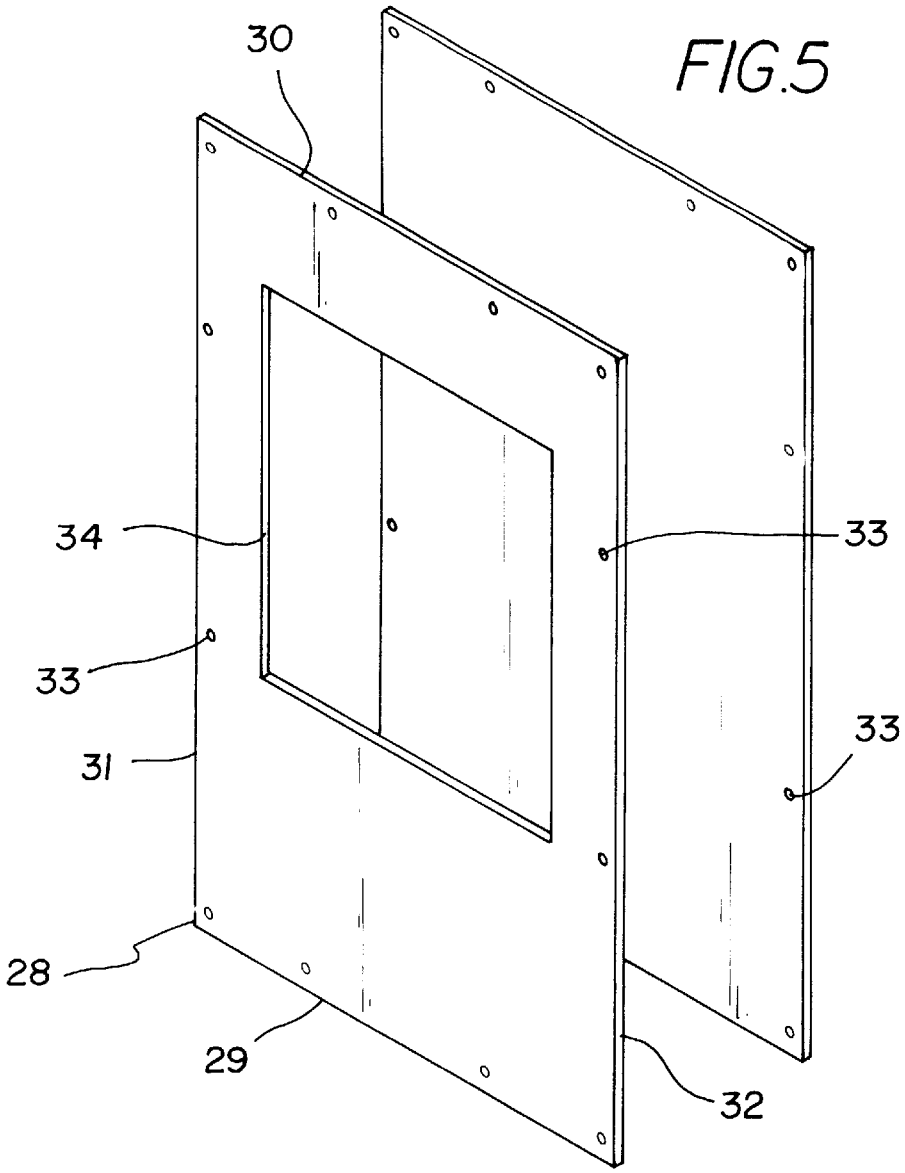
FIG. 5 is a schematic perspective view of the wall panels of the present invention.
Figure 6:
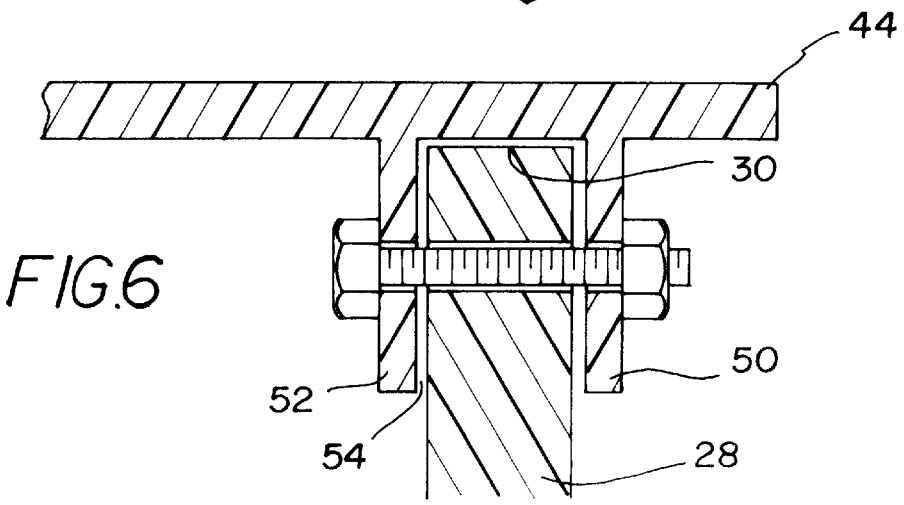
FIG. 6 is a schematic cross-sectional view of a wall panel positioned in a channel of a roof panel of the present invention.
Figure 7:
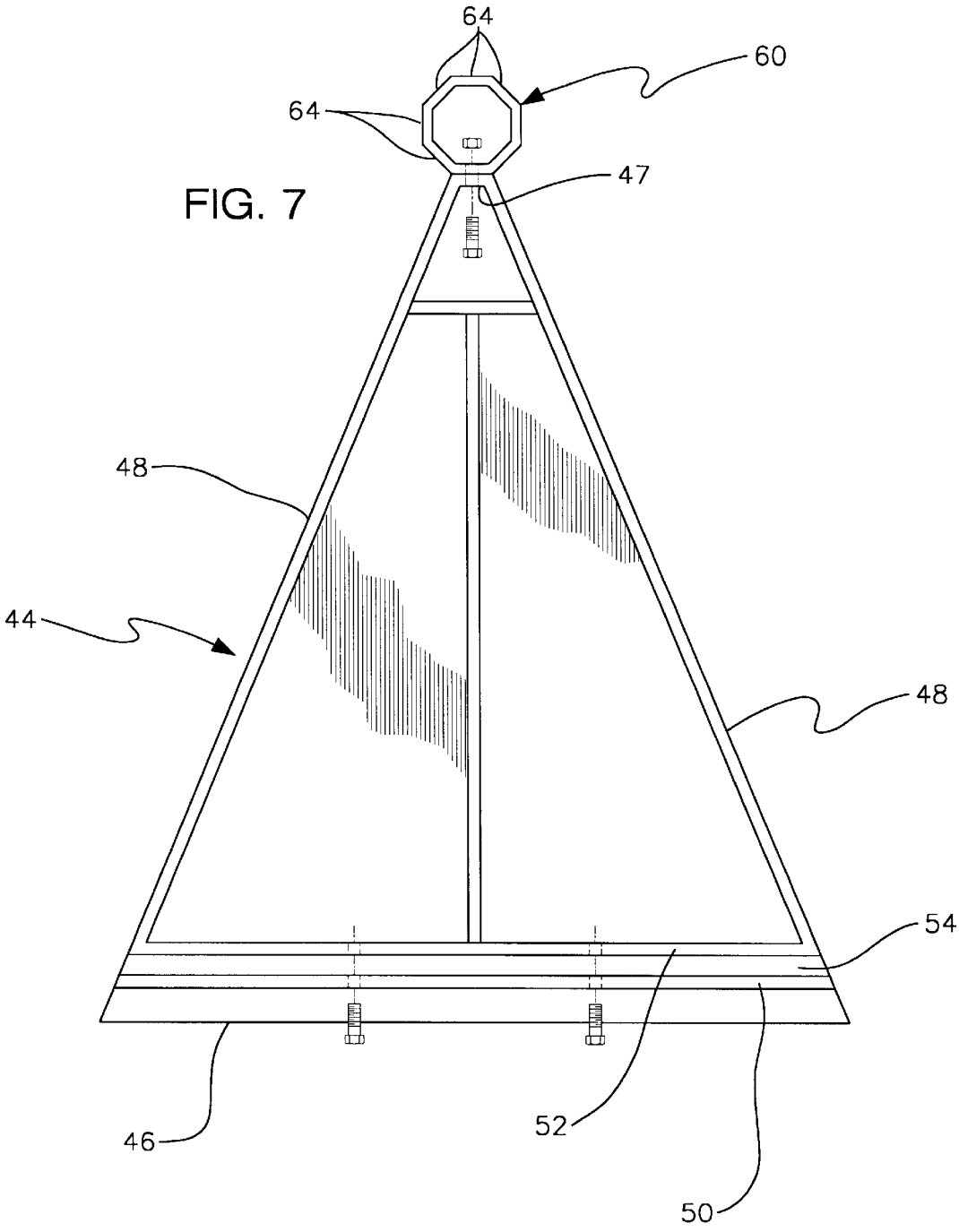
FIG. 7 is a schematic plan view of a roof panel of the present invention.
Figure 8:
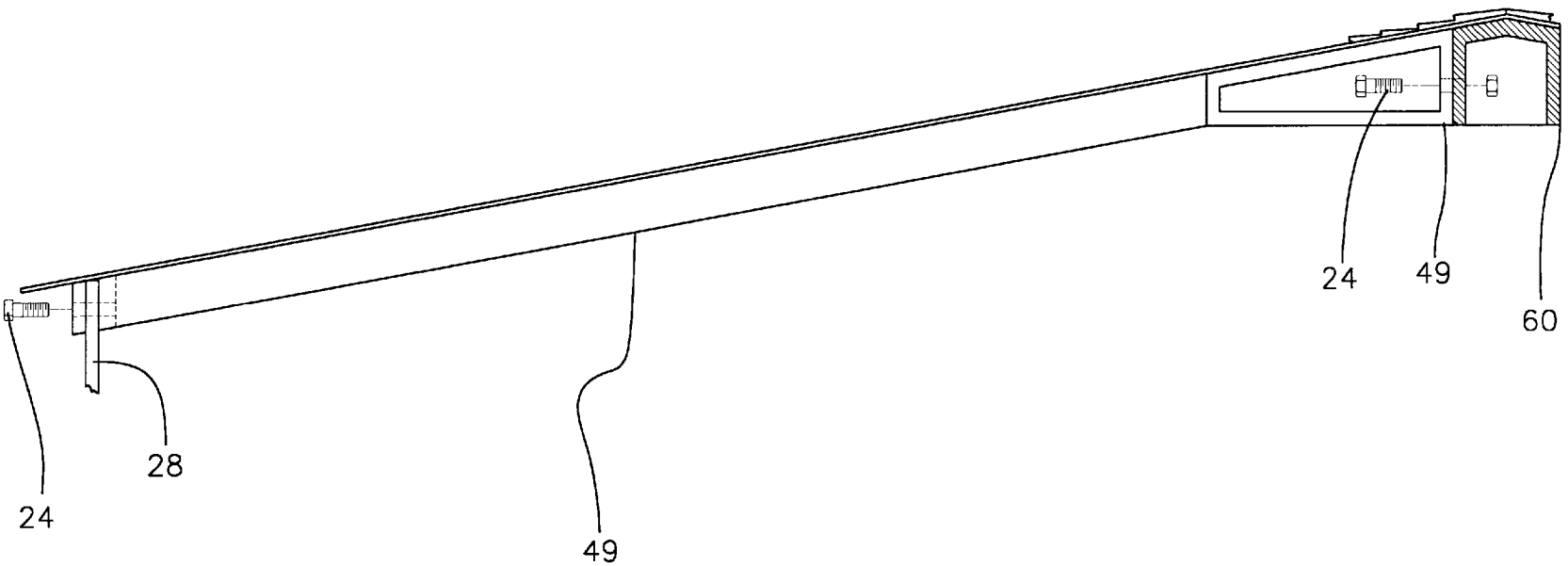
FIG. 8 is a schematic side cross-sectional view of a roof panel of the present invention.
Figure 9:
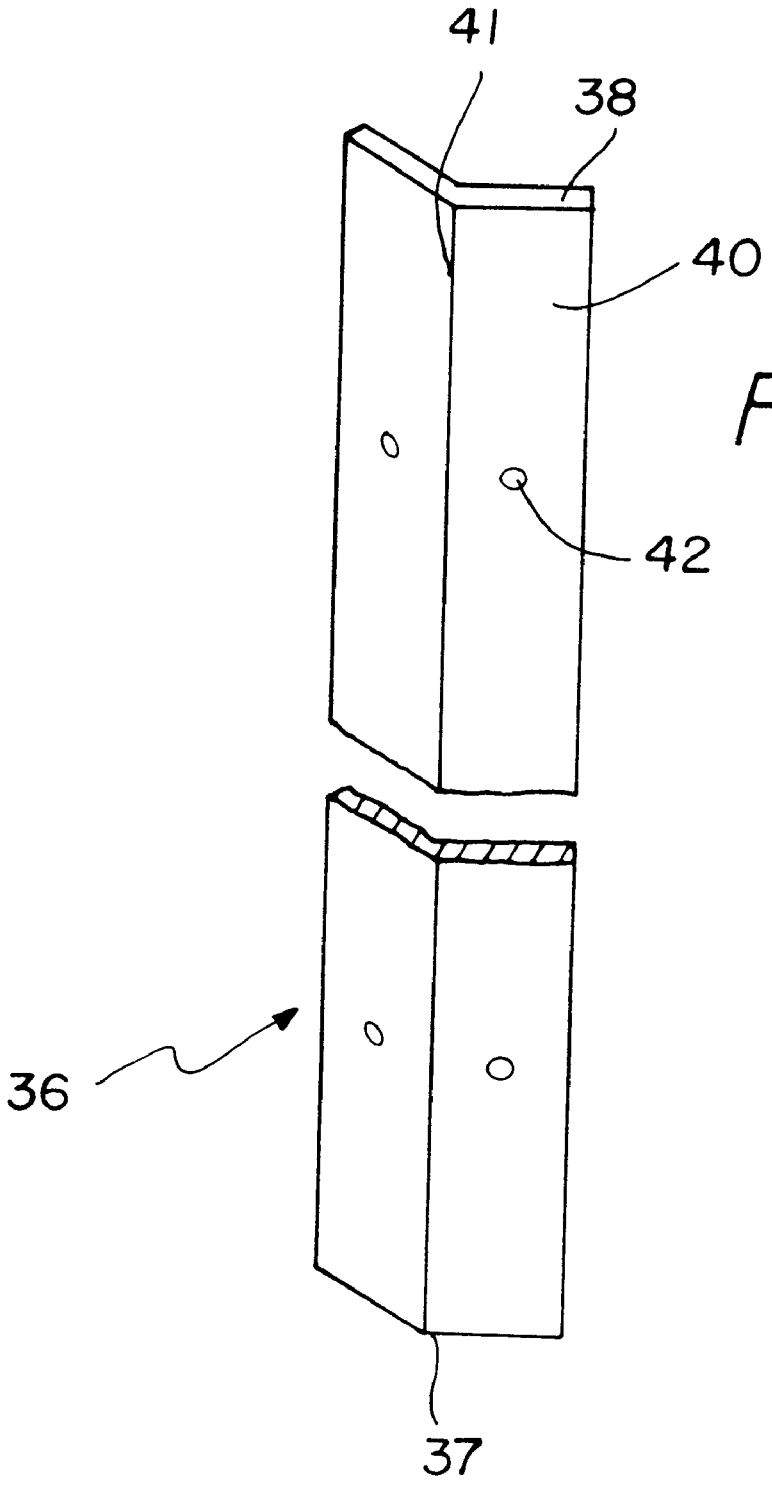
FIG. 9 is a schematic perspective view of the coupling members of the present invention.
Figure 10:
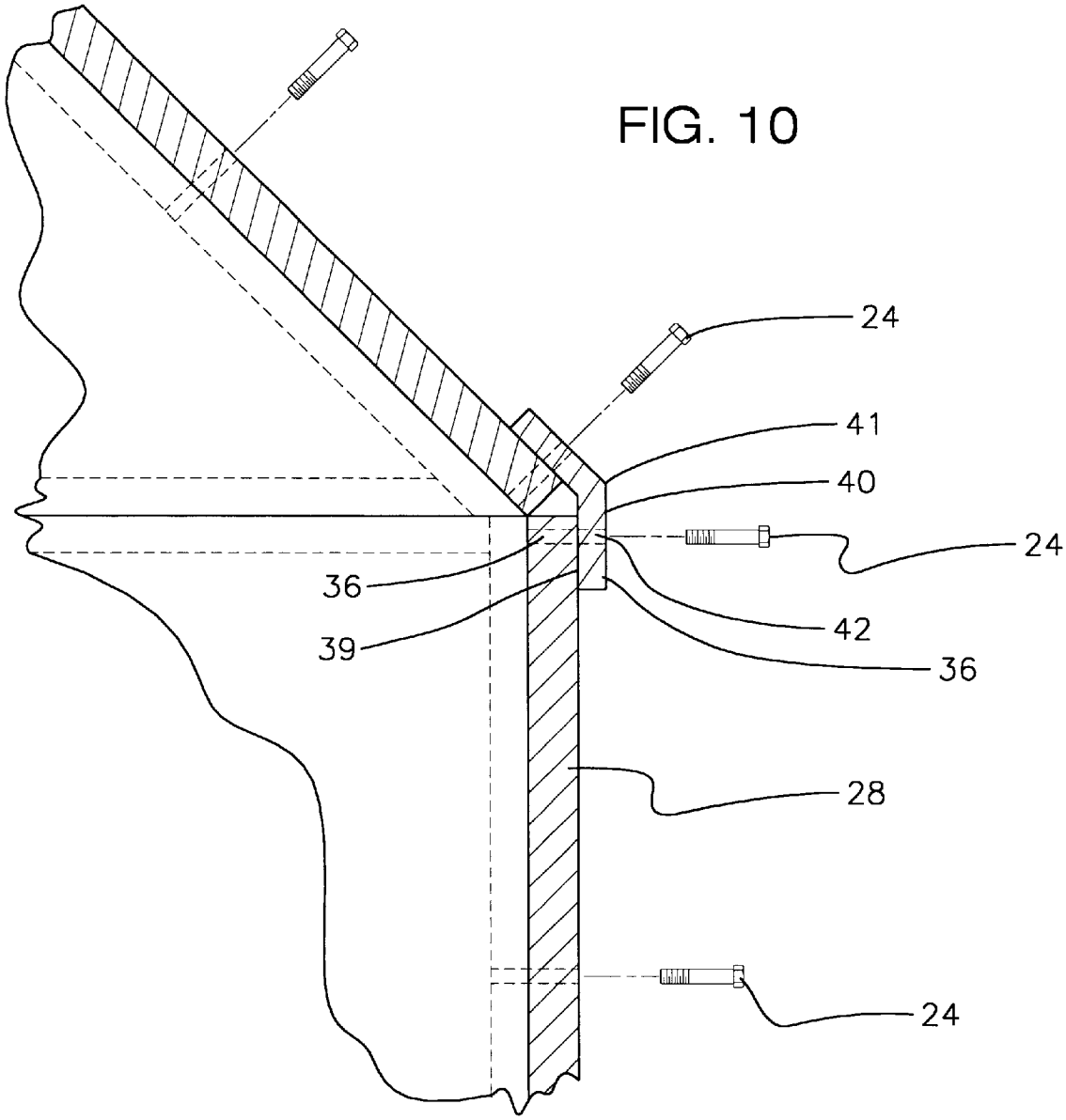
FIG. 10 is a schematic perspective view of the wall panels of the present invention.
Figure 11:
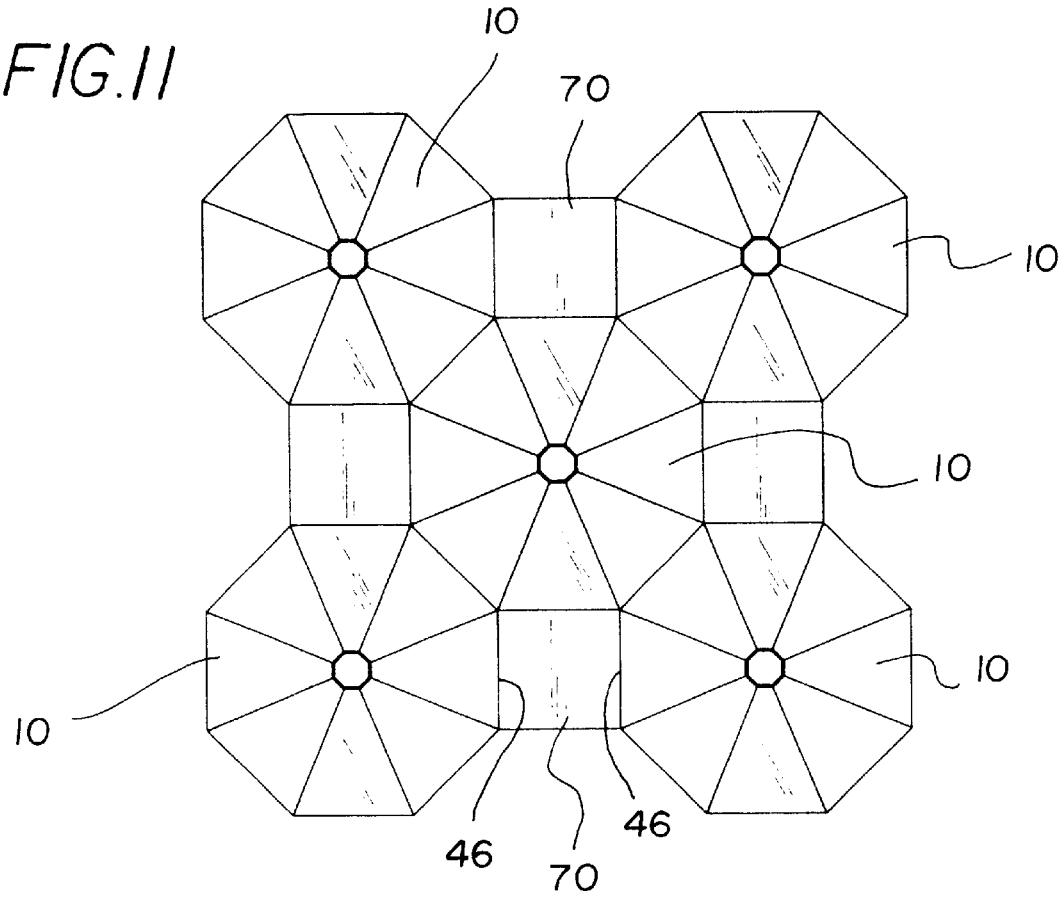
FIG. 11 is a schematic plan view of a plurality of attached gazebos according to the present invention.

With reference now to the drawings, and in particular to FIGS. 1 through 11 thereof, a new prefabricated structure embodying the principles and concepts of the present invention and generally designated by the reference numeral 10 will be described.

As best illustrated in FIGS. 1 through 11, the prefabricated structure 10 generally comprises a deck 12. The deck 12 is comprised of an array of deck panels. The array includes a first 13, a second 14, a third 15, a fourth 16, a fifth 17, and a sixth 18 deck panel. Each of the deck panels has a top surface 19 and a bottom surface 20. The deck panels are situated adjacent to each other to form a two by three matrix. The first panel 13 is located generally adjacent to the second deck panel 14 and the third deck panel 15 and generally diagonally adjacent to the fourth deck panel 16. The fifth deck panel 17 is located generally adjacent to the third deck panel 15 and the sixth deck panel 18 and generally diagonally adjacent to the fourth deck panel 16. Each the deck panels has a perimeter edge 21. Each of the panels has a flange 22 extending downwardly away from the perimeter edges 21. Each of the flanges 22 on the second 14 and fifth 17 panels has a lip 23 thereon extending toward an adjacent panel. The flange 22 on the first panel 13 has a lip 23 thereon positioned adjacent to the third panel 15. The flange 22 on the sixth panel 18 has a lip 23 thereon positioned adjacent to the fourth panel 16. Each of the lips 23 are securely attached to an adjacent flange 22 by a plurality of securing means 24. The securing means mentioned throughout are conventional securing preferably comprising screws or bolts. The deck 12 generally has a geometric shape such that a perimeter of the deck comprises a plurality of side edges 25. The geometric shape is preferably an octagon such that the deck 12 has eight side edges 25.

Each of a plurality of wall panels 28 has a bottom edge 29, a top edge 30, a first side edge 31, and a second side edge 32. Each of the wall panels 28 has plurality of holes 33 therein. The holes 33 are positioned generally adjacent to the edges 29–32 of the wall panels 28. There is at least one wall panel 28 for each side edge 25 of the deck 12. Preferably, each of the wall panels 28 has a window 34 therein. At least one of the wall panels 28 has door 35 therein. Alternatively, a user may choose not to place a wall panel 28 in its position such that the door 35 is not needed. Each of the wall panels 28 is abutted against one of the side edges 25 of side deck 12. Each of a plurality of securing means 24 extends through one of the holes 33 adjacent to the bottom edges 29 of the wall panels 28 and into a corresponding adjacent side edge 25 of the deck 12.

A plurality of coupling members 36 securely couples adjacent walls panels 28 together. Each of the coupling members 36 comprises an elongate plate having a first end 37 and a second end 38. Each of the plates has a front side 39 and a back side 40. Each of the plates has a bend 41 therein extending between the first 37 and second 38 ends such that the front side 39 of the plate may be abutted against a pair of adjacently positioned wall panels 28. Each of the plates has a plurality of openings 42 therein. Each of the openings 42 is positioned to correspond with one of the holes 33 in the wall panels 28 positioned against the first 31 and second 32 side edges of the wall panels 28. Each of a plurality of securing means 24 extends through one of the openings 42 in the coupling member and a corresponding hole 33 in the wall panel 28.

A plurality of roof panels 44 each has a generally trapezoidal shape such that each of the roof panels comprises a first base 46, a second base 47, and two legs 48. The first base 46 has a greater length than the second base 47. Each of the second bases 47 and the legs 48 has a lip 49 extending downwardly therefrom. Each of the roof panels 44 includes a first elongate member 50 and a second elongate member 52. The first elongate member 50 is securely attached to a bottom side of the roof panel 44 and extends between the legs 48. The first elongate member 50 is orientated generally parallel to and positioned generally adjacent to the first base 46. The second elongate member 52 is securely attached to a bottom side of the roof panel and extends between the legs 48. The second elongate member 52 is orientated generally parallel to and spaced from the first elongate member 50. A channel 54 is defined between the first 50 and second 52 elongate members.

A central member 60 for coupling each of the second bases 47 together comprises a tubular member having a first end 61, a second end 62 and a peripheral wall 63 extending therebetween. The central member 60 has a geometrical shape taken transversely to a line extending between the first 61 and second 62 ends. The geometrical shape of the central member 60 is generally identical to the geometrical shape of the deck 12 such that the peripheral wall 63 comprises a plurality of sides 64.

In use, each of the second bases 47 is securely attached to one of the sides 64 of the central member 60. Each of the top edges 30 of the wall panels 28 is positioned in one of the channels 54 of the roof panels 44. Each of the top edges 30 is securely attached to the first 50 and second 52 elongate members by a plurality of securing means 24. The structure 10 is then used as a conventional gazebo. Additionally, filling panels 70 may be used to couple a plurality of structures 10 together. The panels 70 are resemble the other roof panels 44 but are square to couple to the first bases 46 of a plurality of roof panels 44.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A prefabricated structure, comprising:

a deck, said deck generally having a geometric shape such that a perimeter of said deck comprises a plurality of side edges;

a plurality of wall panels, each of said wall panels having a bottom edge, and a top edge, each of said wall panels being positioned against one of said side edges of said deck and securely attached thereto, at least one of said wall panels having a door therein;

a plurality of roof panels, each of said roof panels having a generally trapezoidal shape such that each of said roof panels comprises a first base, a second base, and two legs, said first base having a greater length than said second base, each of said second bases and said legs having a lip extending downwardly therefrom, each of said roof panels having a channel therein orientated generally perpendicular to and positioned generally adjacent to said first base;

a central member for coupling to each of said second bases; and wherein each of said second bases is securely attached to said central member, wherein each of said top edges of said wall panels is positioned in one of said channels of said roof panels.

2. The prefabricated structure as in claim 1, wherein said deck comprises:

said deck comprising an array of deck panels, said array comprising a first, a second, a third, a fourth, a fifth, and a sixth deck panel, each of said deck panels having a top surface and a bottom surface, said deck panels being situated adjacent to each other, wherein said array forms a two by three matrix, said first panel being located generally adjacent to said second deck panel and said third deck panel and generally diagonally adjacent to said fourth deck panel, said fifth deck panel being located generally adjacent to said third deck panel and said sixth deck panel and generally diagonally adjacent to said fourth deck panel, each said deck panel having a perimeter edge, each of said panels having a flange extending downwardly away from said perimeter edges, each of said flanges on said second and fifth panels having a lip thereon extending toward an adjacent panel, said flange on said first panel having a lip thereon positioned adjacent to said third panel, said flange on said sixth panel having a lip thereon positioned adjacent to said fourth panel, wherein each of said lips are securely attached to an adjacent flange by a plurality of securing means.

3. The prefabricated structure as in claim 1, wherein said deck comprises:

said geometric shape of said deck being an octagon such that said deck has eight side edges.

4. The prefabricated structure as in claim 1, wherein each of said wall panels comprises:

each of said wall panels having a first side edge, and a second side edge, each of said wall panels having plurality of holes therein, each of said holes being positioned generally adjacent to said edges of said wall panels, each of a plurality of securing means extending through one of said holes adjacent to said bottom edges of said wall panels and extending into a corresponding adjacent side edge of said deck.

5. The prefabricated structure as in claim 1, wherein said wall panels comprise:

each of said wall panels having a window therein.

6. The prefabricated structure as in claim 1, further comprising:

a plurality of coupling members securely coupling adjacent walls panels together, each of said coupling members comprising an elongate plate having a first end and a second end, each of said plates having a front side and a back side, each of said plates having a bend therein extending between said first and second ends such that said front side of said plate abutted against a pair of adjacently positioned wall panels, wherein each of said plates are securely attached to each of a pair of adjacent wall panels.

7. The prefabricated structure as in claim 1, wherein said central member comprises:

said central member comprising a tubular member having a first end, a second end and a peripheral wall extending therebetween, said central member having a geometrical shape taken transversely to a line extending between said first and second ends, said geometrical shape of said central member being generally identical to the geometrical shape of said deck such that said peripheral wall comprises a plurality of sides; and wherein each of said second bases being securely attached to one of said sides of said central member.

8. A prefabricated structure, comprising:

a deck, said deck being comprised of an array of deck panels, said array comprising a first, a second, a third, a fourth, a fifth, and a sixth deck panel, each of said deck panels having a top surface and a bottom surface, said deck panels being situated adjacent to each other, wherein said array forms a two by three matrix, said first panel being located generally adjacent to said second deck panel and said third deck panel and generally diagonally adjacent to said fourth deck panel, said fifth deck panel being located generally adjacent to said third deck panel and said sixth deck panel and generally diagonally adjacent to said fourth deck panel, each said deck panels having a perimeter edge, each of said panels having a flange extending downwardly away from said perimeter edges, each of said flanges on said second and fifth panels having a lip thereon extending toward an adjacent panel, said flange on said first panel having a lip thereon positioned adjacent to said third panel, said flange on said sixth panel having a lip thereon positioned adjacent to said fourth panel, wherein each of said lips are securely attached to an adjacent flange by a plurality of securing means, said deck generally having a geometric shape such that a perimeter of said deck comprises a plurality of side edges, said geometric shape comprising an octagon such that said deck has eight side edges;

a plurality of wall panels, each of said wall panels having a bottom edge, a top edge, a first side edge, and a second side edge, each of said wall panels having plurality of holes therein, each of said holes being positioned generally adjacent to said edges of said wall panels, wherein there is at least one wall panel for each side edge of said deck, each of said wall panels having a window therein, at least one of said wall panels having a door therein, each of said wall panels being abutted against one of said side edges of said deck, each of a plurality of securing means extending through one of said holes adjacent to said bottom edges of said wall panels and extending into a corresponding adjacent side edge of said deck;

a plurality of coupling members securely coupling adjacent wall panels together, each of said coupling members comprising an elongate plate having a first end and a second end, each of said plates having a front side and a back side, each of said plates having a bend therein extending between said first and second ends such that said front side of said plate is abutted against a pair of adjacently positioned wall panels, each of said plates having a plurality of openings therein, each of said openings being positioned to correspond with one of said holes in said wall panels, each of a plurality of securing means extending through one of said openings in said coupling member and a corresponding hole in said wall panel;

a plurality of roof panels, each of said roof panels having a generally trapezoidal shape such that each of said roof panels comprises a first base, a second base, and two legs, said first base having a greater length than said second base, each of said second bases and said legs having a lip extending downwardly therefrom, each of said roof panels including;

a first elongate member, said first elongate member being securely attached to a bottom side of said roof panel and extending between said legs, said first elongate member being orientated generally parallel to and positioned generally adjacent to said first base;

a second elongate member, said second elongate member being securely attached to a bottom side of said roof panel and extending between said legs, said second elongate member being orientated generally parallel to and spaced from said first elongate member;

wherein a channel is defined between said first and second elongate members;

a central member coupled to each of said second bases, said central member comprising a tubular member having a first end, a second end and a peripheral wall extending therebetween, said central member having a geometrical shape taken transversely to a line extending between said first and second ends, said geometrical shape of said central member being generally identical to the geometrical shape of said deck such that said peripheral wall comprises a plurality of sides; and wherein each of said second bases is securely attached to one of said sides of said central member, wherein each of said top edges of said wall panels is positioned in one of said channels of said roof panels, wherein each of said top edges are securely attached to said first and second elongate members by a plurality of securing means.

* * * * *